US007570140B2

(12) United States Patent
Helms et al.

(10) Patent No.: US 7,570,140 B2
(45) Date of Patent: Aug. 4, 2009

(54) MAGNETIC TRIP MECHANISM INCLUDING A PLUNGER MEMBER ENGAGING A SUPPORT STRUCTURE, AND CIRCUIT BREAKER INCLUDING THE SAME

(75) Inventors: Roger W. Helms, Beaver Falls, PA (US); Yu-Wei Chou, Coraopolis, PA (US); Mark A. Janusek, Pittsburgh, PA (US); William G. Eberts, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 516 days.

(21) Appl. No.: 11/366,032

(22) Filed: Mar. 2, 2006

(65) Prior Publication Data

US 2007/0205852 A1 Sep. 6, 2007

(51) Int. Cl.

| | |
|---|---|
| ***H01H 9/00*** | (2006.01) |
| ***H01H 83/00*** | (2006.01) |
| ***H01H 73/02*** | (2006.01) |
| ***H01H 75/00*** | (2006.01) |
| ***H01H 77/00*** | (2006.01) |

(52) U.S. Cl. ..... 335/172; 335/21; 335/174; 335/175

(58) Field of Classification Search ..... 335/172–176, 335/14, 21

See application file for complete search history.

(56) References Cited

U.S. PATENT DOCUMENTS

| | | | | | |
|---|---|---|---|---|---|
| 1,297,979 | A | * | 3/1919 | Valkenburg | 335/183 |
| 2,041,903 | A | * | 5/1936 | Cole | 335/24 |
| 2,295,691 | A | * | 9/1942 | Russell | 335/39 |
| 3,249,823 | A | * | 5/1966 | Beardow | 335/258 |
| 3,360,751 | A | | 12/1967 | Gauthier et al. | |
| 3,509,505 | A | * | 4/1970 | Zagrzjewski | 335/274 |
| 4,399,421 | A | * | 8/1983 | MacLean | 335/174 |
| 4,503,408 | A | | 3/1985 | Mrenna et al. | |
| 4,677,409 | A | * | 6/1987 | Kozuka et al. | 335/258 |
| 4,698,609 | A | * | 10/1987 | Goehle et al. | 335/255 |
| 4,710,739 | A | * | 12/1987 | Heyne et al. | 335/174 |
| 4,801,907 | A | | 1/1989 | Kelaita, Jr. et al. | |
| 5,144,272 | A | * | 9/1992 | Nishimura | 335/255 |
| 5,381,121 | A | * | 1/1995 | Peter et al. | 335/20 |
| 5,435,519 | A | * | 7/1995 | Everingham | 251/129.15 |
| 5,444,424 | A | * | 8/1995 | Wong et al. | 335/172 |
| 5,453,724 | A | * | 9/1995 | Seymour et al. | 335/172 |
| 5,831,501 | A | | 11/1998 | Kolberg et al. | |
| 5,886,605 | A | * | 3/1999 | Ulerich et al. | 335/172 |
| 5,894,257 | A | * | 4/1999 | Roger et al. | 335/172 |
| 5,901,690 | A | * | 5/1999 | Hussey et al. | 123/568.26 |
| 5,927,484 | A | | 7/1999 | Malingowski et al. | |
| 5,986,528 | A | * | 11/1999 | Meier et al. | 335/6 |
| 6,255,924 | B1 | * | 7/2001 | Turner et al. | 335/157 |

(Continued)

*Primary Examiner*—Elvin G Enad
*Assistant Examiner*—Alexander Talpalatskiy
(74) *Attorney, Agent, or Firm*—Martin J. Moran

(57) ABSTRACT

A circuit breaker includes separable contacts, an operating mechanism structured to open and close the separable contacts, and a magnetic trip mechanism cooperating with the operating mechanism to trip open the separable contacts. The magnetic trip mechanism includes a support structure including a slotted support portion therein, and a plunger assembly. The plunger assembly includes a movable core resting in the support portion of the support structure, and a plunger member including a first portion cooperating with the operating mechanism, a second portion coupled to the movable core, and a third portion engaging the support structure.

2 Claims, 7 Drawing Sheets

U.S. PATENT DOCUMENTS 6,366,187 B1 4/2002 Malingowski et al.
6,768,404 B2 7/2004 Ojeda et al.
6,845,762 B2 * 1/2005 Modien ..... 123/568.21

* cited by examiner

MAGNETIC TRIP MECHANISM INCLUDING A PLUNGER MEMBER ENGAGING A SUPPORT STRUCTURE, AND CIRCUIT BREAKER INCLUDING THE SAME

BACKGROUND OF THE INVENTION

1. Field of the Invention

The invention relates to a magnetic trip mechanism for a circuit breaker and, more particularly, to a magnetic trip mechanism including a movable core. The invention also relates to a circuit breaker including a magnetic trip mechanism, such as a solenoid.

2. Background Information

Circuit breakers are well known in the art. Examples are disclosed in U.S. Pat. Nos. 4,503,408; 5,927,484; 6,366,187; and 6,768,404, which are incorporated by reference herein.

Molded case circuit breakers, for example, typically include separable contacts, an operating mechanism, and a trip unit, which are mounted inside of a molded plastic insulative housing.

A common type of magnetic trip device for a trip unit is a solenoid, which includes a stationary core through which passes the current in the protected circuit. This current creates a magnetic field. When there are relatively very high instantaneous currents, such as those associated with a short circuit, the magnetic field intensifies. The magnetic trip device may include a plunger assembly having a movable core and a plunger tab, which engages a trip bar lever of the operating mechanism. The plunger assembly is partially disposed within the stationary core. Typically, a spring provides a limited force biasing the movable core away from the stationary core and preventing the plunger from engaging the trip bar lever. When a short circuit occurs, the current in the stationary core creates a magnetic field strong enough to overcome the movable core spring, thereby allowing the movable core to move toward the stationary core and causing the plunger to engage the trip bar lever.

U.S. Pat. No. 6,768,404 discloses a movable core positioning member having a hook and an opening. The hook engages the wall of a plunger assembly support structure. The movable core passes through the opening of the positioning member, which retains the movable core within a slot of the plunger assembly support structure. Otherwise, without the movable core positioning member, the plunger assembly may become misaligned relative to the stationary core or the trip bar lever.

As shown in FIG. 1, the plunger assembly 28 of U.S. Pat. No. 6,768,404 includes a movable core 30 having a cylindrical portion 32, a coil spring 34 and a molded plunger member 35. The movable core 30 is preferably a solid metal cylinder. The molded plunger member 35 includes a resilient C-shaped opening 37 that may be suitably expanded to be disposed about and grasp the movable core 30. The coil spring 34 is also disposed about the movable core 30. The plunger assembly 28 is disposed within a cavity 29 of a plunger assembly support structure 50. However, the molded plunger member 35 may rotate about the movable core 30 until it assumes the position shown in phantom line drawing in FIG. 1. If the molded plunger member 35 rotates to this position after the circuit breaker (not shown) has tripped (e.g., which may be the position in which the manufactured circuit breaker is shipped), then the plunger tab 36 (shown in phantom line drawing) prevents the trip bar 21 from rotating (as shown at arrow 49) back from a tripped position to a reset position. This could keep the circuit breaker from resetting.

Also, if the circuit breaker (not shown) is latched (i.e., open or closed) and the molded plunger member 35 rotates to the position shown in phantom line drawing, then the circuit breaker may trip somewhat prematurely.

Accordingly, there is room for improvement in circuit breakers and magnetic trip mechanisms including a movable core.

SUMMARY OF THE INVENTION

This need and others are met by a movable core plunger member including a first portion cooperating with an operating mechanism, a second portion coupled to the movable core, and a third portion engaging a support structure of a magnetic trip mechanism.

In accordance with one aspect of the invention, a circuit breaker comprises: at least one pair of separable contacts; an operating mechanism structured to open and close the at least one pair of separable contacts; and a magnetic trip mechanism cooperating with the operating mechanism to trip open the at least one pair of separable contacts, the magnetic trip mechanism comprising a support structure including a support portion therein, and a plunger assembly comprising a movable core resting in the support portion of the support structure, and a plunger member including a first portion cooperating with the operating mechanism, a second portion coupled to the movable core, and a third portion engaging the support structure.

The third portion of the plunger member may retain the plunger member relative to the support structure, and the second portion of the plunger member may retain the movable core relative to the plunger member and to the support portion of the support structure.

The third portion of the plunger member may retain the plunger member relative to the support structure and prevent rotation of the plunger member about the movable core.

The movable core may include a cylindrical portion, and the second portion of the plunger member may form a generally circular opening receiving the cylindrical portion.

The movable core may include a cylindrical portion, and the second portion of the plunger member may include a body having a pair of resilient arms forming a generally circular opening, the resilient arms receiving and grasping the cylindrical portion.

The third portion of the plunger member may have an L-shape with a first leg disposed from the second portion of the plunger member and a second leg engaging the support structure.

The support portion may be a first slot; the support structure may further include a second slot therein; and the third portion of the plunger member may engage the support structure at the second slot.

As another aspect of the invention, a magnetic trip mechanism for cooperating with an operating mechanism to trip open separable contacts comprises: a support structure including a support portion therein; and a plunger assembly comprising a movable core resting in the support portion of the support structure, and a plunger member including a first portion structured to cooperate with the operating mechanism, a second portion coupled to the movable core, and a third portion engaging the support structure.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

Figure 2:
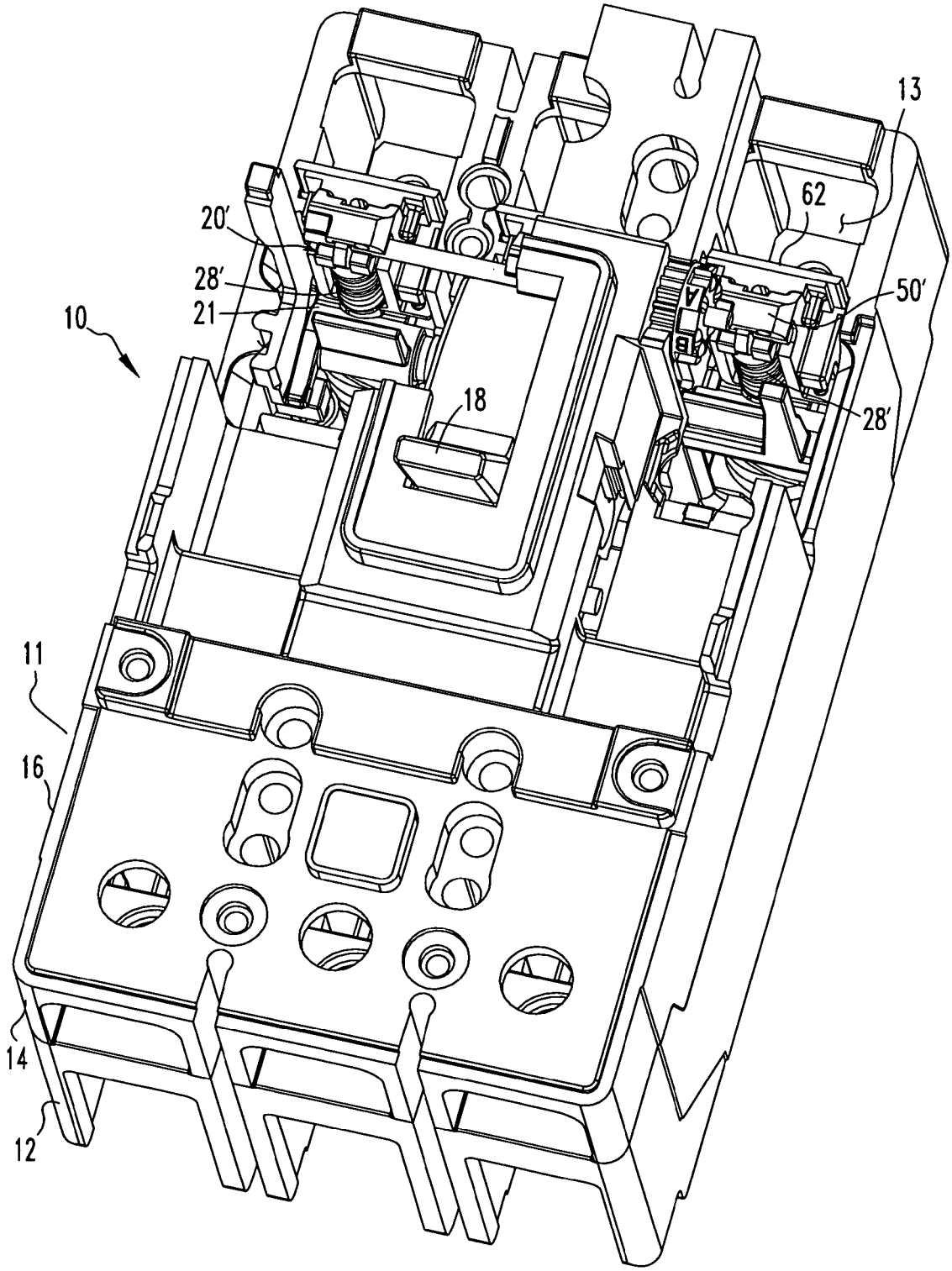
FIG. 2 is a partial cut away view of a circuit breaker housing incorporating plunger assemblies in accordance with an embodiment of the invention.

FIG. 2 shows a molded case circuit breaker 10 including a housing 11 having a base portion 12, which is coupled to a primary cover 14. The base portion 12 includes a plurality of cavities 13, which support the various circuit breaker components. Disposed on top of the primary cover 14 is a secondary cover 16. An operating handle 18 protrudes through the secondary cover 16.

At least one pair (e.g., without limitation, three pairs) of main contacts 2,4 (one pair is shown in hidden line drawing in FIG. 4) is disposed within housing 11, although the invention is applicable to circuit breakers having any number of poles. The contacts include a movable contact 2 and a stationary contact 4. The movable contact 2 is coupled to and is in electrical communication with the load side of the circuit breaker 10. The stationary contact 4 is coupled to and is in electrical communication with an electrical line (not shown). The operating handle 18 is coupled to the movable contact 2 within the circuit breaker housing 11 and may be used to reset the circuit breaker 10 after it has been tripped or to manually open or close the circuit breaker.

Figure 3:
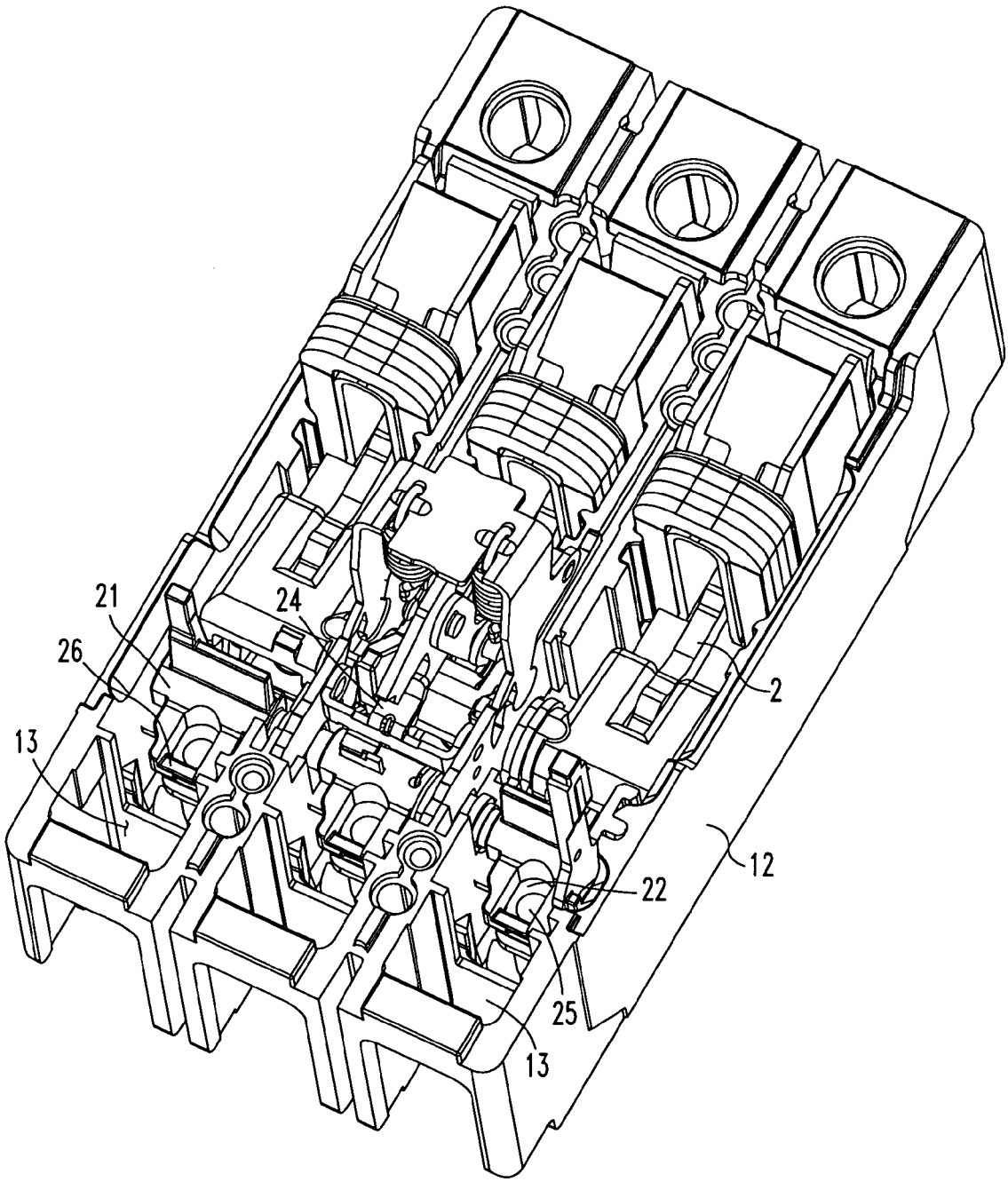
FIG.3 PRIOR ART
FIG. 3 is an isometric view of a circuit breaker with top covers and plunger carriages removed.
Figure 4:
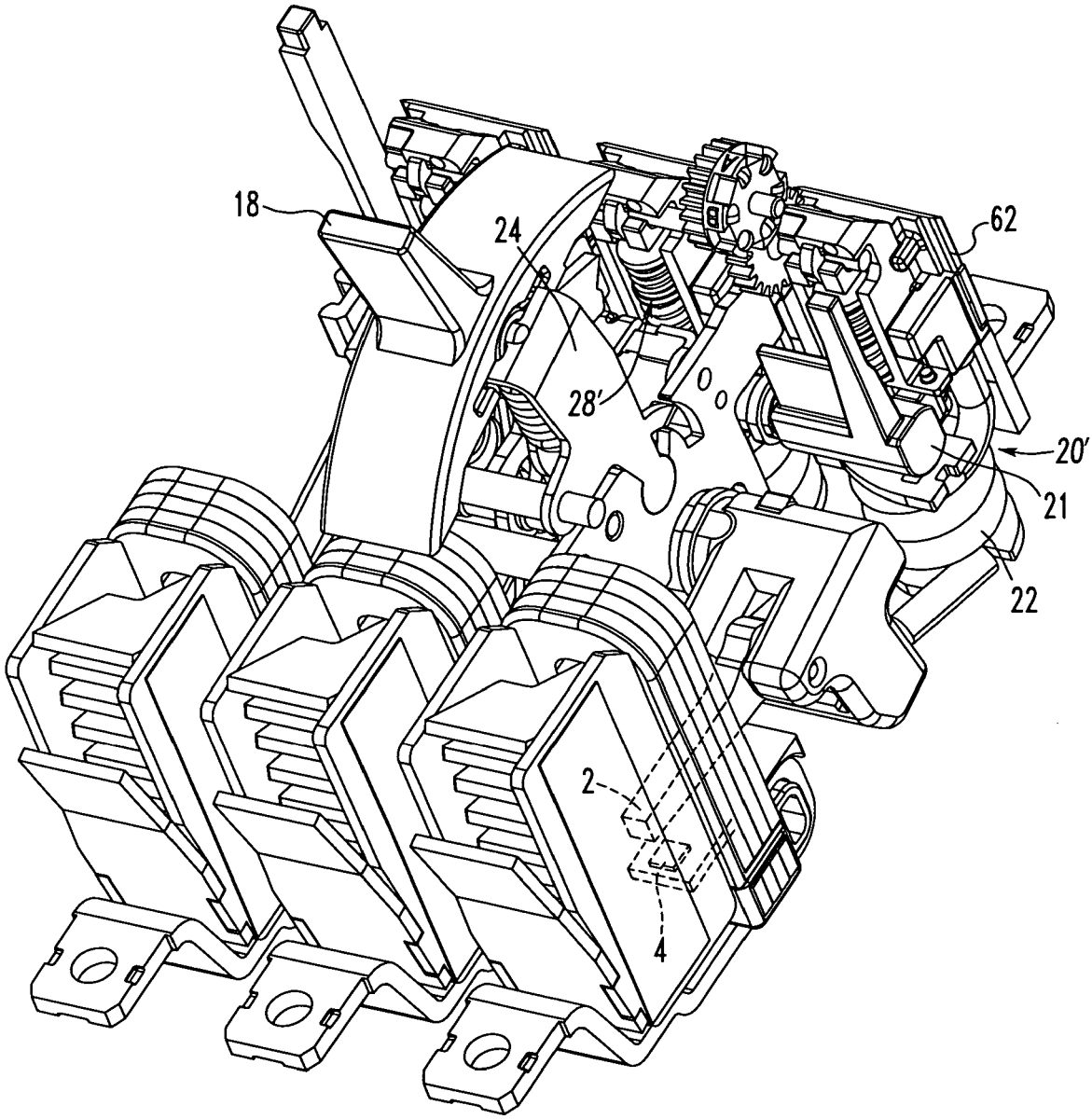
FIG. 4 is an isometric view of a circuit breaker mechanism without the circuit breaker housing of FIG. 2.

Referring to FIGS. 2 and 4, a separate magnetic trip assembly 20' may trip the circuit breaker 10. A latchable operating mechanism 24 (FIG. 4) is structured to open and close the separable contacts 2,4. The magnetic trip assembly 20' cooperates with a rotating trip bar 21 of the operating mechanism 24 to trip open the separable contacts 2,4. As is well known, rotation of the trip bar 21 releases the operating mechanism 24 allowing the circuit breaker 10 to trip. The trip bar 21 includes at least one actuating arm 26 (FIGS. 3 and 8), which is adjacent to the magnetic trip assembly 20'.

Figure 6:
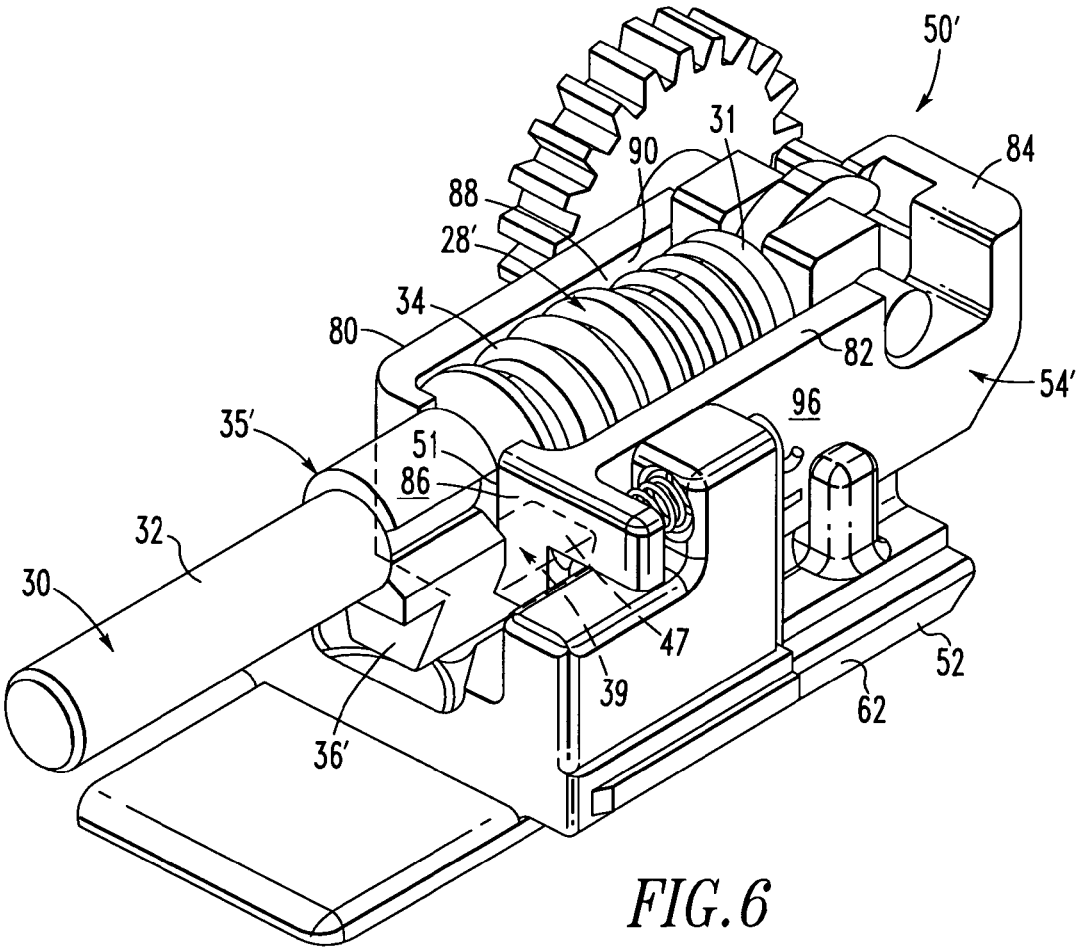
FIG. 6 is an isometric view of one set of the plunger assemblies, plunger carriage support structures and molded plunger members of FIG. 5.

Referring to FIGS. 2 and 6, the magnetic trip assembly 20' includes a stationary core 22 (FIG. 3), a plunger assembly 28', and a plunger assembly support structure 50'. The stationary core 22 is disposed within one of the cavities 13 in the bottom housing 12, forms a portion of the load circuit through the circuit breaker 10, and is operatively associated with a movable core 30, as will be discussed. The stationary core 22 is preferably shaped as a coil. The stationary core 22 includes a medial aperture 25 (FIG. 3), preferably having a circular cross-section. The stationary core 22 is disposed between the movable main contact 2 and the load side of the breaker 10. When current flows through the stationary core 22, a magnetic field generating a magnetic force is created.

Figure 7:
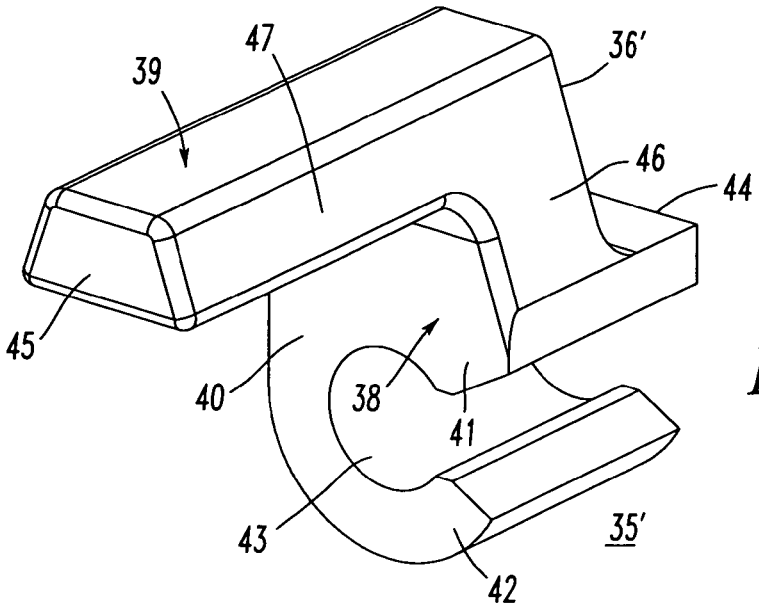
FIG. 7 is an isometric view of the molded plunger member of FIG. 5.

As shown in FIG. 6, the plunger assembly 28' includes the movable core 30 having a flattened end 31 and the cylindrical portion 32, the coil spring 34, and a molded plunger member 35' (as best shown in FIG. 7) having a plunger tab 36'. The movable core 30 is preferably a solid metal cylinder. The coil spring 34 is disposed about the movable core 30. The plunger assembly 28' is disposed within a cavity 88 of the plunger assembly support structure 50'.

Figure 8:
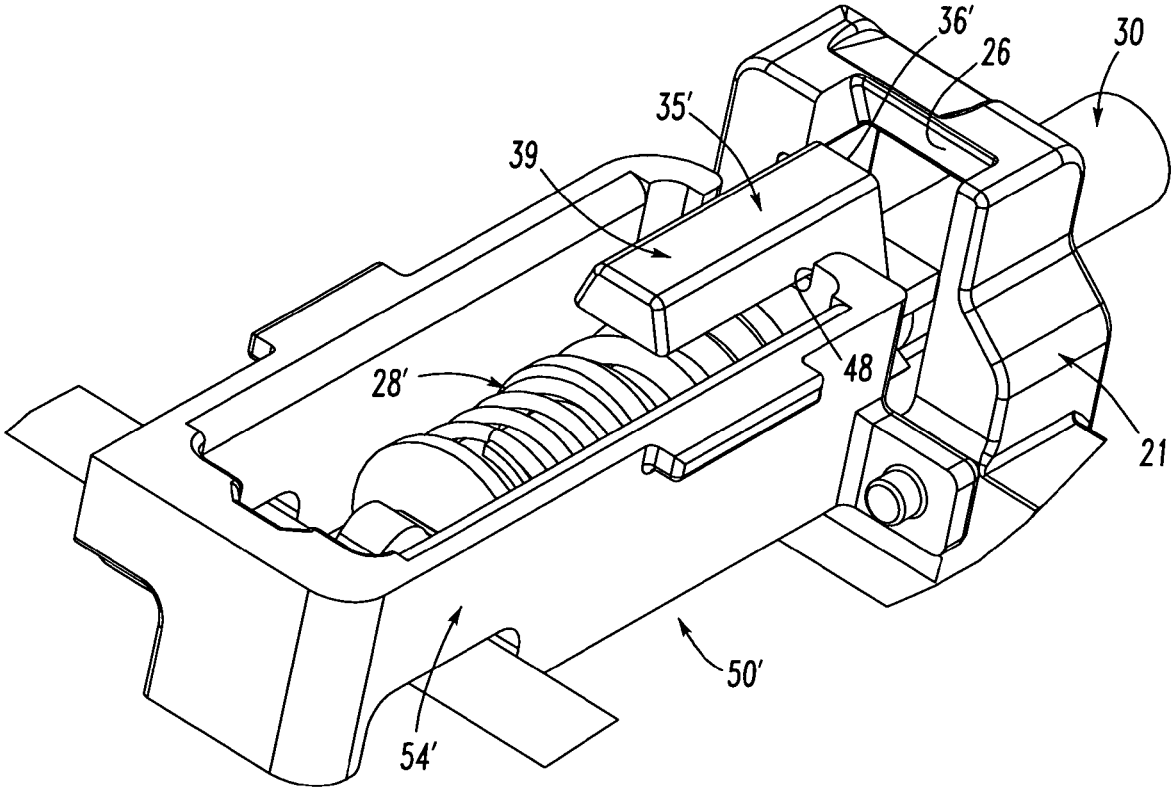
FIG. 8 is a bottom isometric view of one set of the plunger assemblies, plunger carriage support structures and molded plunger members of FIG. 5.

The movable core 30 rests in a support portion, such as first slot 51 of a plunger carriage assembly 54' of support structure 50'. Without the molded plunger member 35', during assembly and in the event of an over-current condition, the movable core 30 may move out of the slot 51 (and out of the cavity 88) and, hence, without member 35', the position of the movable core 30 in the slot 51 of the plunger carriage assembly 54' may change. Also, without member 35', this may cause the plunger tab 36' to hit random locations of the actuating arm 26 of the trip bar 21 (FIG. 8).

The plunger assembly support structure 50' includes a base member assembly 52 and the plunger carriage assembly 54'. The plunger assembly 28' is disposed within the plunger carriage assembly 54', which is slidably disposed adjacent to the base member assembly 52. The plunger carriage assembly 54' is slidable, in order that the distance between the movable core 30 and the stationary core 22 (FIGS. 3 and 4), and, therefore, the trip condition of the circuit breaker 10, may be selectively adjusted. Except for the molded plunger member 35' (FIG. 7) and the second slot 48 (FIG. 8) of the plunger carriage assembly 54', the plunger assembly support structure 50' is generally disclosed in incorporated by reference U.S. Pat. No. 6,768,404.

Figure 5:
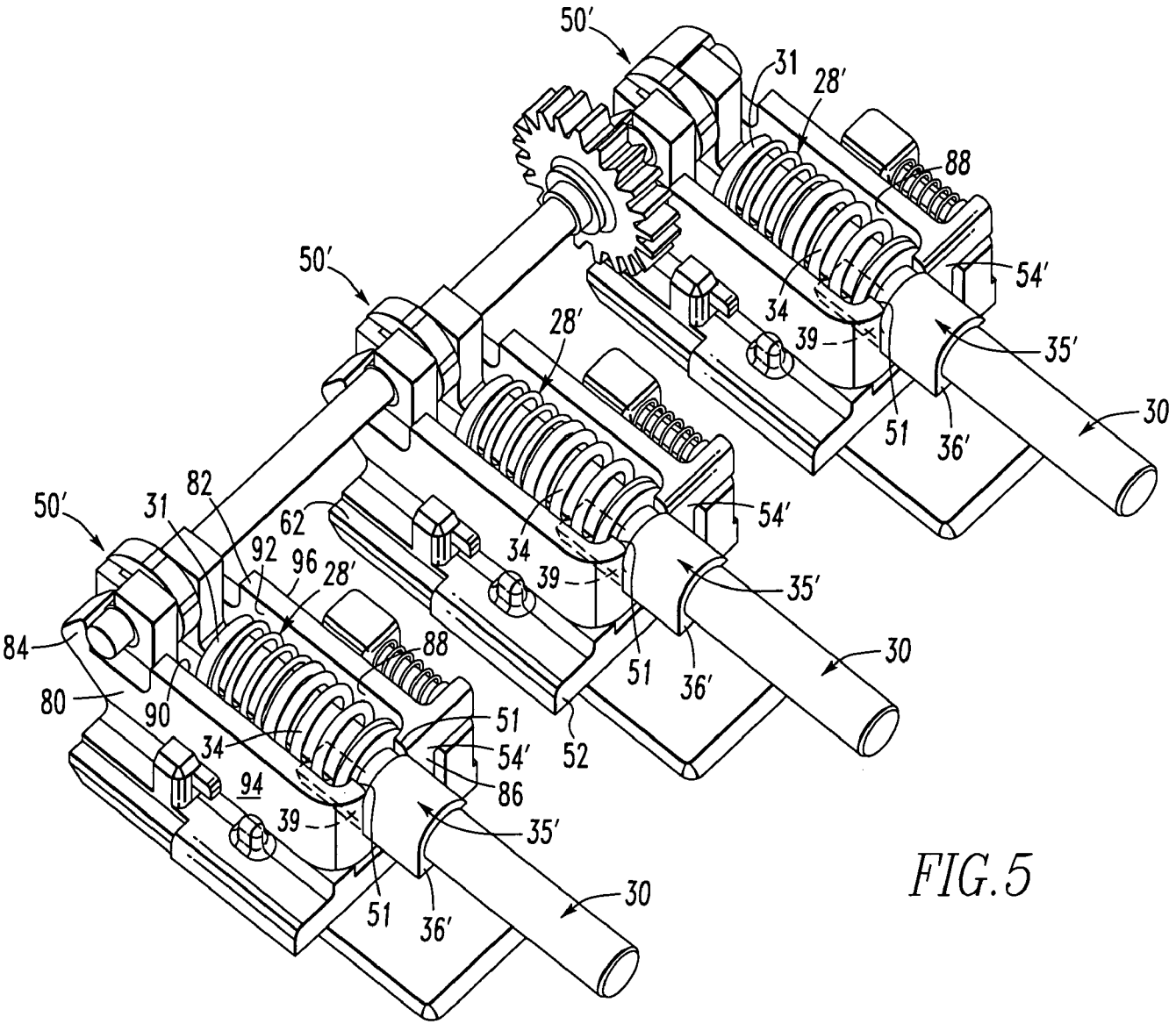
FIG. 5 is an isometric view of three plunger assemblies, three plunger carriage support structures and three molded plunger members in accordance with an embodiment of the invention.

Also referring to FIG. 5, the plunger carriage assembly 54' includes a first side member 80 and a second side member 82. The first side member 80 and the second side member 82 are held in spaced relation by a top member 84 and a bottom member 86. An open-faced cavity 88 is formed between the first side member 80 and the second side member 82. Both the first side member 80 and the second side member 82 have interior sides 90,92 and exterior sides 94,96, respectively.

Under normal operating conditions, the coil spring 34 overcomes the magnetic force created by the electric current through the stationary core 22 (FIGS. 3 and 4) and biases the flattened end 31 of the movable core 30 away from the plunger carriage bottom member 86 and the stationary core 22. The biasing force of the coil spring 34 also prevents the plunger tab 36' from engaging the trip bar actuating arm 26.

Referring to FIGS. 6-8, the molded plunger member 35' includes a first portion 36' cooperating with the operating mechanism 24 (FIG. 4) through the trip bar actuating arm 26 (FIG. 8), a second portion 38 coupled to the movable core 30, and a third portion 39 engaging the support structure 50' (as best shown in FIG. 8). The plunger member third portion 39 advantageously retains the plunger member 35' relative to the support structure 50' during all movements of the movable core 30. The plunger member third portion 39 also prevents rotation of the plunger member 35' about the movable core 30.

The plunger member second portion 38 retains the movable core 30 relative to the plunger member 35' and to the slot 51 of the support structure 50'. The plunger member second portion 38 forms a body 40 having a pair of resilient arms 41,42 forming a generally circular opening 43. The resilient arms 41,42 may be bent to first receive and, then, grasp the movable cylindrical portion 32. In this manner, the body 40 is coupled to the movable core 30 and supports the first and third portions 36',39 of the plunger member 35'. The first portion 36' is disposed from the body 40 toward a first end 44 thereof, and the third portion 39 is disposed from the body 40 toward the opposite second end 45 thereof. The third portion 39 has an L-shape with a first leg 46 disposed from the body 40 and a second leg 47 engaging the support structure 50'.

As shown in FIG. 8, the support structure 50' includes a second slot 48 therein, which is opposite the first slot 51 of FIG. 6. The third portion 39 of the plunger member 35' engages the support structure 50' at the second slot 48. Alternatively, a suitable small gap may normally be between the third portion 39 and the second slot 48, which would permit relatively small, but insignificant, rotation of the plunger member 35' relative to the movable core 30. The first portion 36' is a plunger tab structured to engage the trip bar actuating arm 26.

Figure 1:
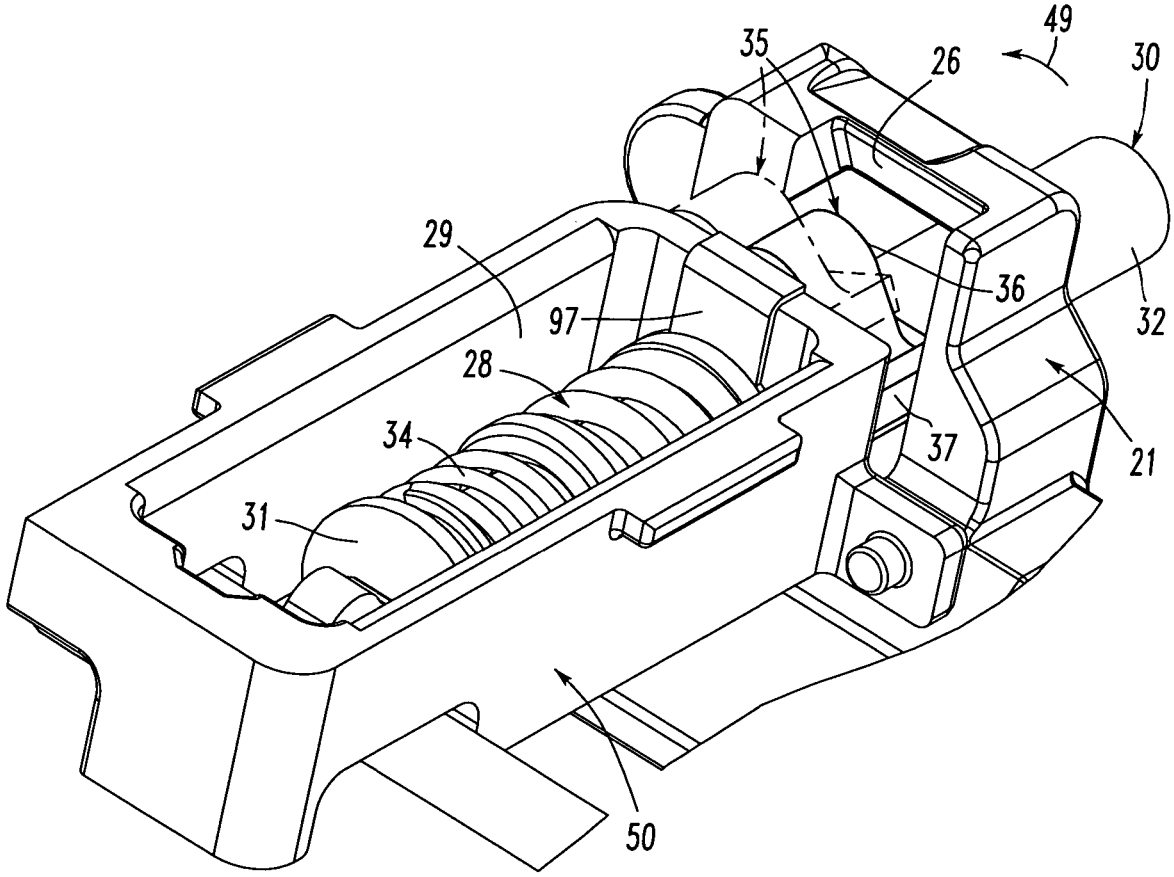
FIG. 1 PRIOR ART
FIG. 1 is an isometric view of a plunger assembly including a molded plunger member.

When an over-current condition occurs, the magnetic force created by the current through the stationary core 22 (FIG. 4) increases in strength. When the magnetic force becomes strong enough to overcome the bias of the coil spring 34, the plunger assembly 28' is drawn towards the stationary core 22. As the plunger assembly 28' is drawn towards the stationary core 22, the plunger tab 36' engages the trip bar actuating arm 26 causing the trip bar 21 to rotate clockwise (with respect to FIGS. 4 and 8). When the trip bar 21 rotates, the latchable operating mechanism 24 is released allowing the circuit breaker 10 to trip. When the plunger assembly 28' moves, either because of an over-current condition or due to adjustment by a user, the third portion 39 of the molded plunger member 35' maintains the movable core 30 in the slot 51 (FIG. 6) and prevents rotation of the plunger tab 36'. Otherwise, without the molded plunger member 35', the plunger assembly 28' may become misaligned relative to the trip bar actuating arm 26. In this manner, the movable core positioning member 97 (FIG. 1) of U.S. Pat. No. 6,768,404 is eliminated.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A magnetic trip mechanism for cooperating with an operating mechanism to trip open separable contacts, said magnetic trip mechanism comprising:

a support structure including a support portion therein; and a plunger assembly comprising a movable core resting in the support portion of said support structure, and a plunger member including a first portion structured to cooperate with said operating mechanism, a second portion coupled to said movable core, and a third portion engaging said support structure, wherein said support portion is a first slot;

wherein said support structure further includes a second slot therein, said second slot being opposite said first slot; and wherein the third portion of said plunger member engages said support structure at said second slot.

2. A circuit breaker comprising:

at least one pair of separable contacts;

an operating mechanism structured to open and close said at least one pair of separable contacts; and a magnetic trip mechanism cooperating with said operating mechanism to trip open said at least one pair of separable contacts, said magnetic trip mechanism comprising a support structure including a support portion therein, and a plunger assembly comprising a movable core resting in the support portion of said support structure;

a plunger member including a first portion cooperating with said operating mechanism, a second portion coupled to said movable core, and a third portion engaging said support structure; and wherein said support portion is a first slot; wherein said support structure further includes a second slot therein; and wherein the third portion of said plunger member engages said support structure at said second slot.

* * * * *